US011718453B2

(12) United States Patent
Andrews et al.

(10) Patent No.: US 11,718,453 B2
(45) Date of Patent: Aug. 8, 2023

(54) SYSTEM AND COUPLING DEVICE FOR POURING

(71) Applicant: THE PURE POUR LLC, Boynton Beach, FL (US)

(72) Inventors: Daniel F. Andrews, Boca Raton, FL (US); Paul Helman, Boynton Beach, FL (US)

(73) Assignee: THE PURE POUR LLC, Boynton Beach, FL (US)

( * ) Notice: Subject to any disclaimer, the term of this patent is extended or adjusted under 35 U.S.C. 154(b) by 0 days.

(21) Appl. No.: 16/755,844

(22) PCT Filed: Oct. 13, 2018

(86) PCT No.: PCT/US2018/055778
§ 371 (c)(1),
(2) Date: Apr. 13, 2020

(87) PCT Pub. No.: WO2019/075442
PCT Pub. Date: Apr. 18, 2019

(65) Prior Publication Data

US 2021/0198016 A1 Jul. 1, 2021

Related U.S. Application Data

(60) Provisional application No. 62/572,166, filed on Oct. 13, 2017.

(51) Int. Cl.

| | |
|---|---|
| ***B65D 47/06*** | (2006.01) |
| ***B01F 23/2361*** | (2022.01) |
| *B01F 23/237* | (2022.01) |

(52) U.S. Cl.
CPC ..... *B65D 47/06* (2013.01); *B01F 23/2361* (2022.01); *B01F 23/237611* (2022.01); *B65D 2547/066* (2013.01)

(58) Field of Classification Search
CPC ..... B65D 47/06; B65D 47/32; B65D 25/48; B65D 25/40; B67D 3/0041; B67D 3/0051; B01F 3/04794
USPC ..... 222/566–570, 477, 478, 500
See application file for complete search history.

(56) References Cited

U.S. PATENT DOCUMENTS

| | | | | | |
|---|---|---|---|---|---|
| 579,867 | A * | 3/1897 | Fenn | B21G 3/18 | 215/40 |
| 1,409,812 | A * | 3/1922 | Anderson | B65D 47/06 | 222/481 |
| 1,437,197 | A * | 11/1922 | Redifer | B65D 47/16 | 141/309 |
| 1,447,117 | A * | 2/1923 | Balison | B65D 47/06 | 222/556 |
| 2,171,302 | A * | 8/1939 | Conner | B65D 47/061 | 222/539 |
| 2,232,370 | A * | 2/1941 | Conner | B65D 47/061 | 222/542 |

(Continued)

*Primary Examiner* — Charles P. Cheyney
(74) *Attorney, Agent, or Firm* — Dickinson Wright PLLC

(57) ABSTRACT

A pouring system comprising a spout retainer and a pour spout that form a liquid-tight seal when attached to, or disposed with respect to, a liquid container, such as a bottle, thereby reducing or eliminating losses from poor seals suffered by use of conventional pour spouts. A spout retainer is configured to forms an essentially liquid-proof seal with an open portion of a container and a pour spout inserted into the container.

12 Claims, 15 Drawing Sheets

(56) References Cited

U.S. PATENT DOCUMENTS 2,368,540 A * 1/1945 Goodman ..... G01F 11/265 222/481
2,438,024 A * 3/1948 Stransky ..... B65D 47/06 215/390
2,497,134 A * 2/1950 Muenze ..... B65D 47/06 222/479
2,727,644 A * 12/1955 Giannos ..... B65D 47/06 222/400.7
2,759,642 A * 8/1956 Rickard ..... B65D 25/48 222/479
2,819,824 A * 1/1958 Ebert ..... B65D 47/06 40/311
2,828,054 A * 3/1958 Chiaramonte ..... B65D 49/04 222/479
2,951,619 A * 9/1960 Strumor ..... B65D 47/06 40/311
3,104,786 A * 9/1963 Sanchis ..... B65D 47/06 222/533
3,235,133 A * 2/1966 Zimmerman ..... B65D 47/06 222/189.06
3,434,636 A * 3/1969 Kachman ..... G01F 11/263 222/567
3,630,419 A * 12/1971 Pierce ..... B65D 47/06 222/478
3,834,594 A * 9/1974 Schiemann ..... B65D 25/40 222/479
5,746,358 A * 5/1998 Crosby ..... B65D 47/06 222/479
7,089,975 B2 * 8/2006 Chrisco ..... B67D 7/005 141/285
7,537,141 B1 * 5/2009 Robinson ..... B65D 47/147 222/569
8,827,123 B2 * 9/2014 Mainville ..... B65D 47/06 222/481.5
9,254,944 B1 * 2/2016 Peckels ..... B65D 25/48
10,259,622 B2 * 4/2019 Hill ..... B65D 41/0442
2012/0181307 A1 7/2012 Grosser

* cited by examiner

SYSTEM AND COUPLING DEVICE FOR POURING

CROSS-REFERENCE TO RELATED APPLICATIONS

This application is a National Stage entry, under 35 U.S.C. § 371, of international Application PCT/US2018/055778, filed Oct. 13, 2018, which claims priority to prior U.S. Provisional Patent Application No. 62/572,166, filed Oct. 13, 2017, the entire disclosure of which is incorporated herein by reference.

BACKGROUND

1. Field of Disclosure

Generally, exemplary embodiments of the present disclosure relate to devices attachable to containers that facilitate dispensing of container's content out of the container, and more particularly to pouring devices attachable to liquid containers, such as bottles.

2. Background of Disclosure

Conventional pour spouts (or pourers) are designed to be inserted into a container, such as a bottle. Accordingly, as illustrated in FIG. 5, such conventional pour spouts 50 have base portion 55 (typically made of rubber), for insertion into a bottle, such that liquid from the bottle can be poured out of the container via a spout 51 permanently attached to (or integrally formed with) the base portion at its wider portion 53.

One of the disadvantages of such conventional pourers is that they are prone to leakage, for example around the base portion 55. Another disadvantage is that a grip on a liquid container around or near the pourer can be slippery.

SUMMARY

Exemplary embodiments of the disclosure address at least one or more of such drawbacks by providing a system and a device that allow a spout to be disposed, or retained, with respect to a liquid container to facilitate reduction or elimination of leakage when liquid is being poured out of the container via a spout, and provide at least the advantages described below.

According to one aspect of the present disclosure there is provided a pouring system comprising a pour spout with a hollow interior with a bottom section for insertion into an open end of a container and a top section extending away from the container, and a spout retainer with a body having a hollow cavity defined by an interior surface of a wall for receiving the open end of the container, and a top having an opening for passing at least a top section of the pour spout therethrough. The retainer portion can be releasably fixed to the open end of the container and can retains the pour spout with respect to said container. The retainer portion and the pour spout form an essentially liquid-proof seal with the open portion of said container.

According to another aspect of the present disclosure there is provided a spout retainer comprising a body having a hollow cavity defined by an interior surface of a wall for receiving an open end of a container, and a top having an opening for passing at least as top portion of a pour spout extending from the container, such the body of the spout retainer can be releasably fixed to the open end of the container, and form an essentially liquid-proof seal with the open portion of the container and the pour spout.

According to an exemplary implementation, the top of the spout retainer comprises a protrusion surrounding the opening for passing the top section of the pour spout forming an essentially liquid-proof seal between the spout retainer and the pour spout.

Optionally, in any of the preceding aspects, a spout can further comprise an aerator tube passing into the container and out of the opening of the top of the spout retainer.

Optionally, in any of the preceding aspects, interior surface of the wall of the spout retainer can comprise at least one ridge forming an interference fit with at least a portion of an outer surface of the open end of the container received within the cavity of the body of the spout retainer.

Optionally, in any of the preceding aspects, the top and the wall of the body of the spout retainer can be integrally formed.

Optionally, in any of the preceding aspects, at least the top section of the pour spout can be curved.

Optionally, in any of the preceding aspects, an exterior surface of the body of the spout retainer can comprise at least one gripping portion.

Optionally, in any of the preceding aspects, an interior surface of the wall of the body of the spout retainer can form an essentially liquid-proof seal with an exterior surface of the container surrounding the open portion of the container.

BRIEF DESCRIPTION OF THE DRAWINGS

The above and other objects, advantages and salient features of the disclosure will become apparent to those skilled in the art from the following detailed description of illustrative embodiments thereof when taken in conjunction with the accompanying drawings in which.

EXEMPLARY EMBODIMENTS OF DISCLOSURE

The matters exemplified in this description are provided to assist in a comprehensive understanding of exemplary embodiments of the disclosure. Accordingly, those of ordinary skill in the art will recognize that various changes and modifications of the embodiments described herein can be made without departing from the scope and spirit of the disclosure. Also, descriptions of well-known functions and constructions are omitted for clarity and conciseness.

As would be readily appreciated by skilled artisans in the relevant art, while descriptive terms such as "pourer", "base", "tube", "spout", "ring", "bottle", "grip", "hole", "bottom", "top", "side", "section". "portion", and others are used throughout this specification to facilitate understanding, it is not intended to limit any components that can be used in combinations or individually to implement various aspects of the embodiments of the present disclosure.

Exemplary embodiments of the present disclosure provide a pouring system comprising a spout retainer 10 and a pour spout 40 that form a liquid-tight seal when attached to, or disposed with respect to, a liquid container, such as a bottle, as described below, thereby reducing or eliminating losses from poor seals suffered by use of conventional pour spouts.

Figure 1:
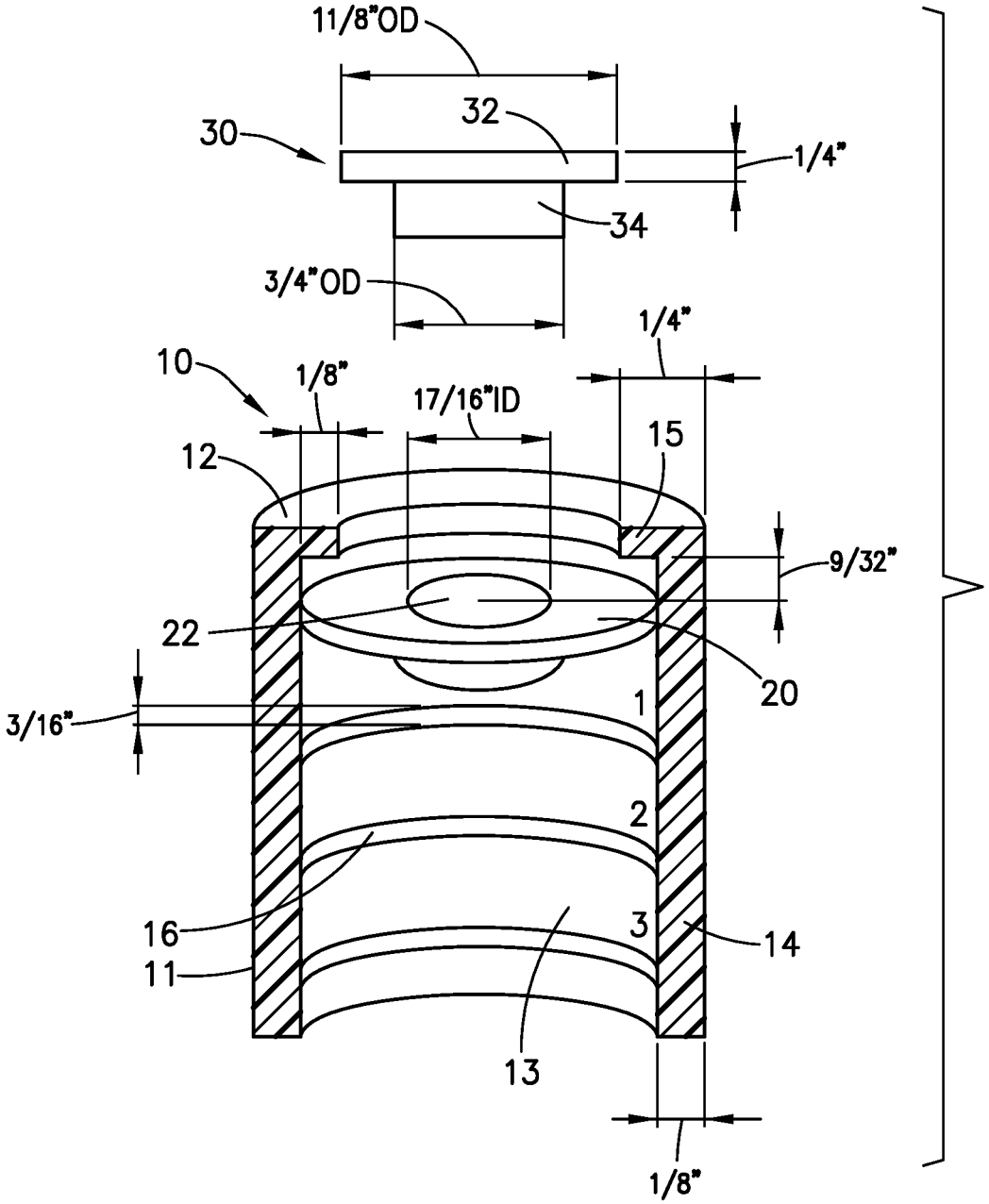
FIGS. 1, 3 and 4 illustrates an example of a spout retainer, and spout retainer components, according to exemplary embodiments of present disclosure.
Figure 3:
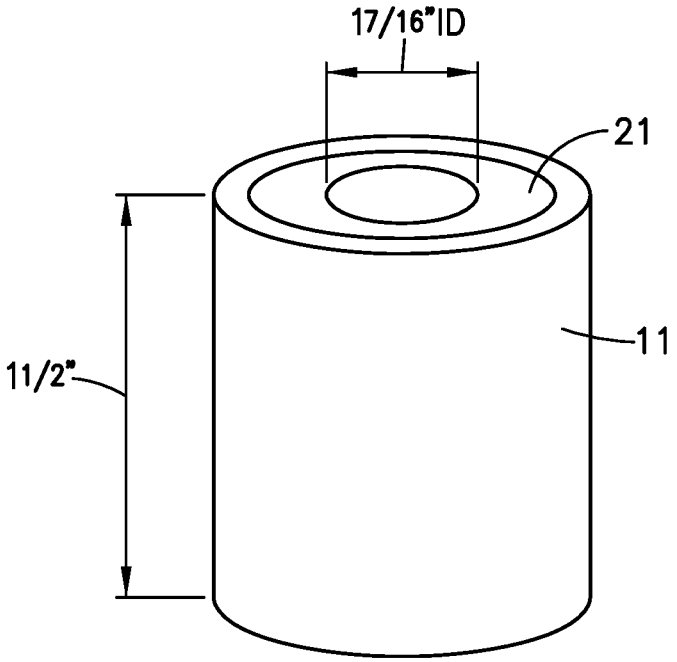
Figure 4:
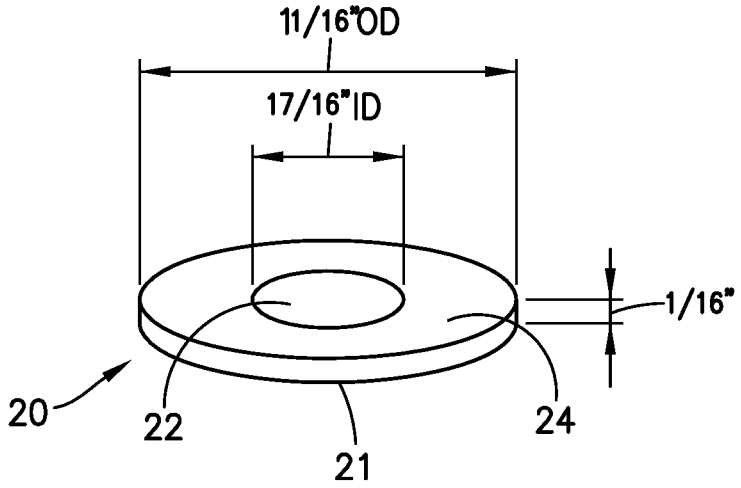
Figure 5:
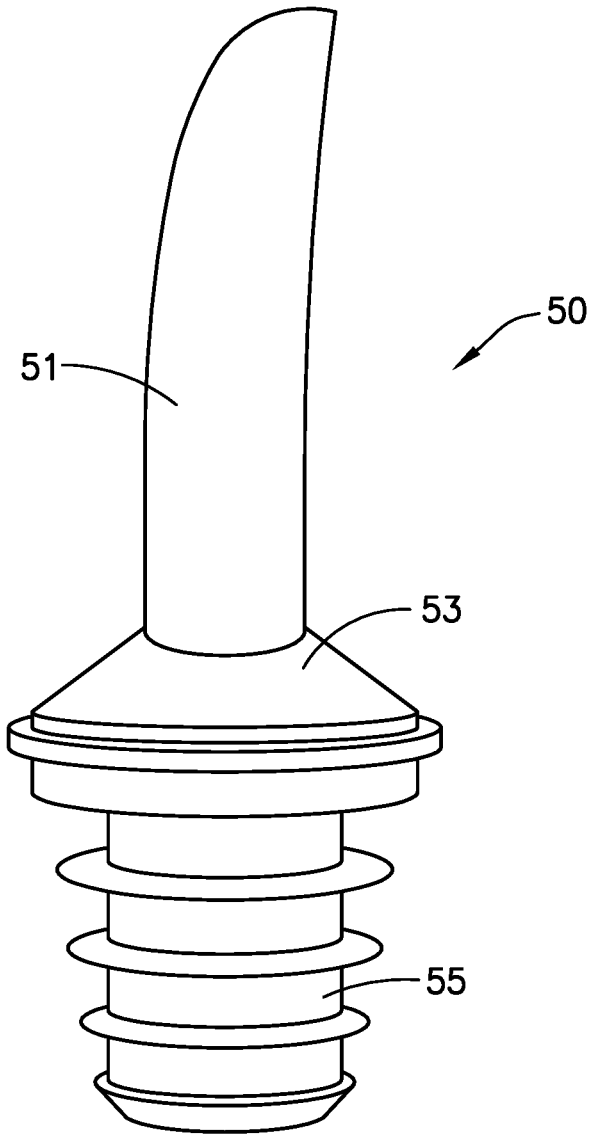
FIG. 5 illustrates an example of a conventional pourer.

Referring to FIGS. 1, 3 and 4, according to exemplary implementations of embodiments of the disclosure, spout retainer 10 comprises a body 11 having a hollow cavity 13 defined by an interior surface of wall 14 for receiving an open end of a liquid container, such as a bottle. In an exemplary non-limiting implementation, wall 14 can be essentially cylindrical. Interior surface of wall 14 can include one or more ridges 16, for example formed as spaced circular ridges as illustrated in FIG. 1, to interface or cooperate, for example by an interference fit, with exterior surface of an open end of a container received within cavity 13 to facilitate essentially liquid-proof fit and to retain, or to facilitate retention of, or to surround and already retained, pour spout 40 within the opening of the container.

In an exemplary implementation, there are 3 ridges 16, for example evenly spaced within cavity 13, and/or at a certain distance with respect to bottom of top of cavity 13 such as one at ½" down and one at 1" down, and one at the bottom, of interior surface of wall 14.

In yet another exemplary implementation, spout retainer 10 comprises a top section 20 including body 21 which can be formed as an essentially planar portion 24 with an opening/hole 22 therethrough. In an exemplary implementation illustrated in FIGS. 1 and 4, top section 20 can be disposed within cavity 13 at a top end 12 thereof such that hole 22 is axially concentric with respect to cavity 13, and top section 20 is axially retained within cavity 13 by overhanging portion 15 of body 11, as further illustrated for example in FIG. 3. According to another exemplary implementation, top section 20 can be integrally formed as part of body 11.

Figure 2B:
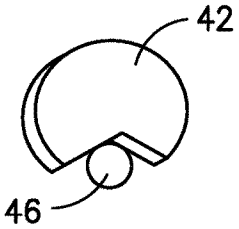
FIGS. 2A, 2B, and 2C illustrate an example of a spout according to exemplary embodiments of present disclosure.
Figure 2C:
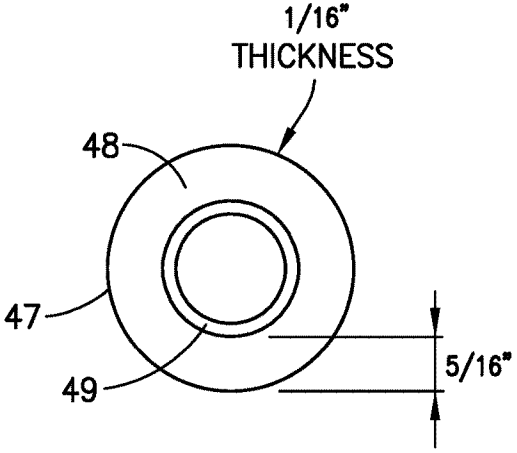
Figure 2A:
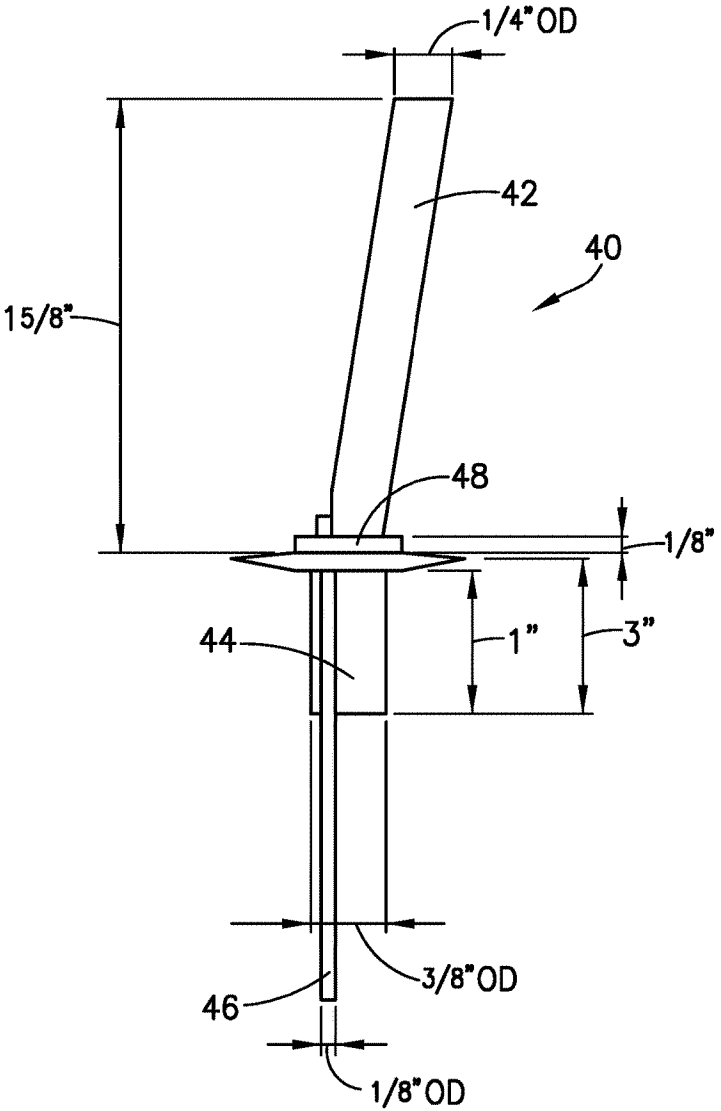

Referring to FIGS. 2A, 2B, and 2C, according to exemplary implementations of embodiments of the disclosure, pour spout 40 can comprise a hollow interior for passing content of a container therethrough, a top section 42 and a bottom section 44, such that when assembled and/or configure on a container, retainer top section 42 extends out of the top 12 of retainer 10 via opening 22 in top section 20, and bottom section 44 extends into opening part of the container, which opening part is retained within cavity 13 of retainer 10.

Figure 6:
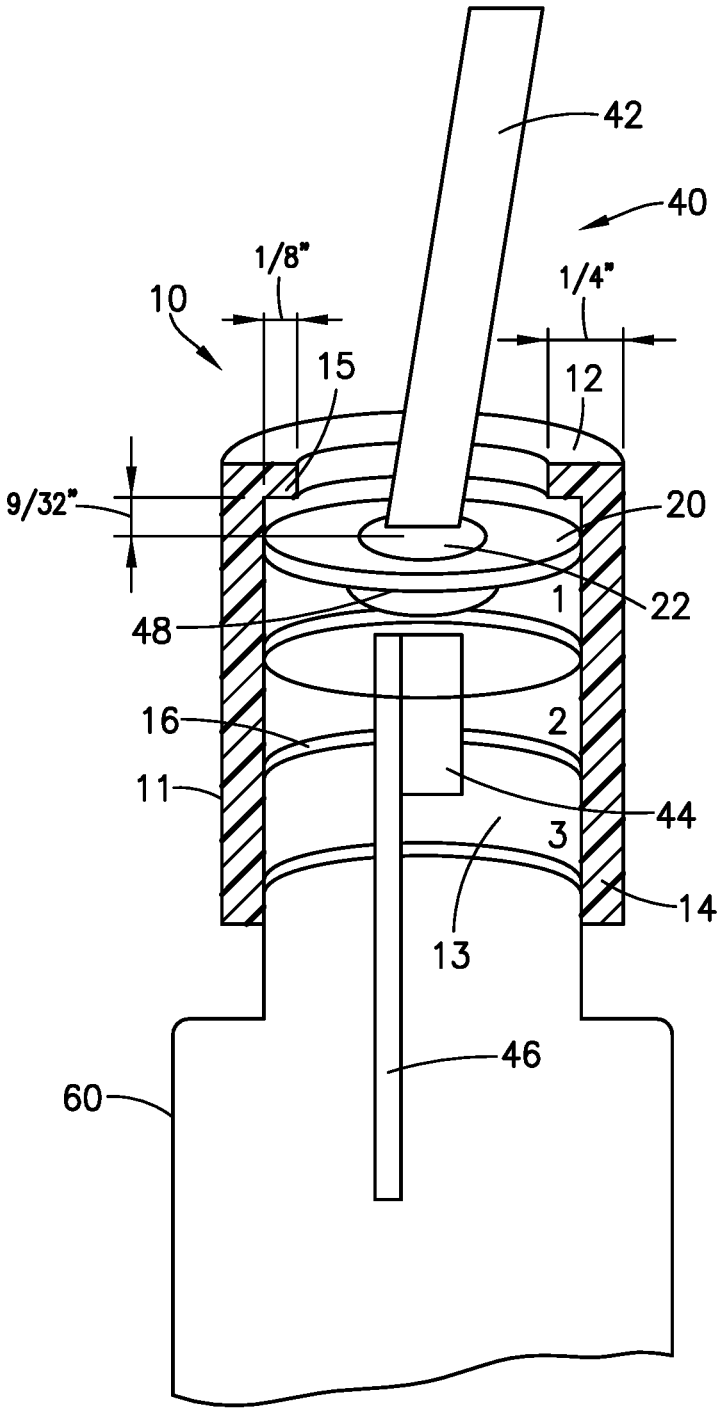
FIG. 6 illustrates an example of a system according to exemplary embodiments of present disclosure.

In an exemplary implementation, pour spout 40 further comprises a wide portion 48 comprising body 47 with opening 49 having top portion 42 extending therethrough, as shown in a cross-section view in example of FIG. 2B, configured under top section 20 when assembled with retainer 10 to facilitate retention of spout 40 with respect to container 60, as shown in examples of FIGS. 2A and 6. In yet further exemplary implementation, pour spout 40 comprises a tube (e.g., an aerator tube) 46, configured with respect to sections 42 and 44 as shown in a cross-section view in the example of FIG. 2C, extending into container 60 and out of opening 22.

In still further exemplary implementation, pour spout 40 can have a base with an outside diameter (O.D.) of ⅜" O.D. and finish at the top at ¼" O.D. with a slight curve in portion 42 on the way up, as illustrated by way of example and without limitation in FIG. 2A.

According to an exemplary implementation, when assembled or configure on a container, top section 20 and body (or grip section) 11, which can be all one piece, fits on an open end portion of a container, such as a top of liquor bottle, whereby top portion 42 of pour spout 40 slides through opening/hole 22 (e.g., 7/16" diameter) in a snug fit with at least to top section 20 of retainer 10. In an example where top section 20 and body 11 are not integrally formed, top section 20 snaps under overhang (or lip) 15 of body (or grip section) 11. Grip section, or body 11, of retainer 10 can facilitate a better grip of container 60, particularly close to the opening of container 60, which is advantageous when dispensing liquid out of container 60 via spout 40.

According to exemplary embodiments of the disclosure, interior surface of wall 14 can have any shape, such as cross-sectionally square, circular, oval, rectangular, non-symmetric, etc., as long as wall 14 and/or ridges 16 interface or cooperate with exterior surface of an open end of liquid container received within cavity 13 to facilitate essentially liquid-proof fit and to retain pour spout 40 within the opening of the liquid container.

According to yet further exemplary embodiments of the disclosure, exterior surface of wall 14 can have any shape, such as cross-sectionally square, circular, oval, rectangular, non-symmetric, etc., and can optionally include gripping elements such as ridges, rough surface portions, etc., to facilitate securing operation of spout retainer 10 and pour spout 40 to open end of liquid container received within cavity 13.

According to still further exemplary embodiments of the disclosure, opening 22 can have any shape, such as cross-sectionally square, circular, oval, rectangular, non-symmetric, etc., to accept any shape of extending portion 42 of pour spout 40 therethrough as long as it does not compromise the retention of pour spout 40 by spout retainer 10 and maintenance of an essentially liquid-tight seal as described in the disclosure.

According to still further exemplary embodiments of the disclosure, retainer 10 and spout 40 can be integrally formed, or formed as a unitary body.

According to still further exemplary embodiments of the disclosure, the system further comprises a removable cap 30, as illustrated in example of FIG. 1, including an essentially planar top part 32 and a downwardly extending part 34. In an exemplary implementation, removable cap 30 can be disposed within cavity 13, for example with or without top section 20, to seal opening of a container, such as container 60, for example by insertion of part 34 into opening of container 60 and retention of top 32 under overhang (or lip) 15 of body (or grip section) 11.

Figure 7:
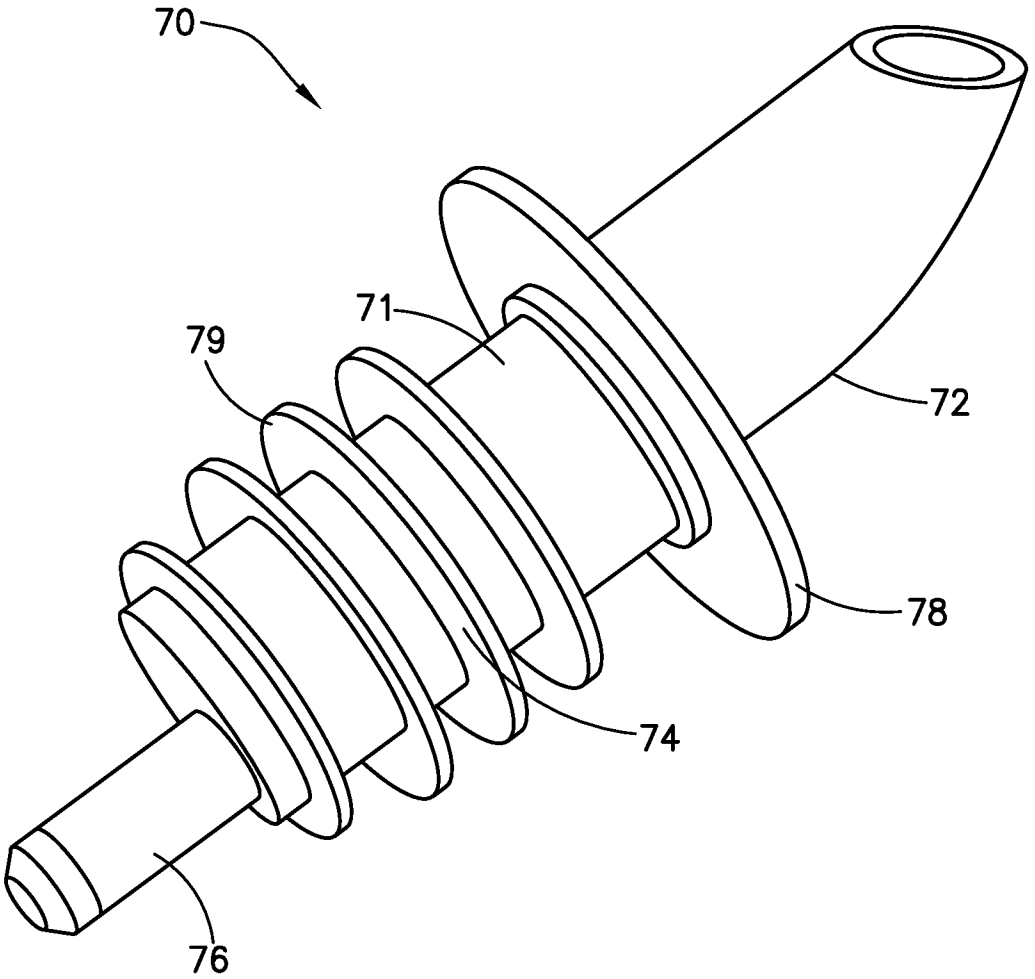
FIG. 7 illustrates an example of a spout according to further exemplary embodiments of present disclosure.

Referring to FIG. 7, according to still further exemplary embodiments of the disclosure, pour spout 70 comprises a unitary body 71 (for example plastic molded) with a hollow interior for passing content of a container therethrough, a top section 72 and a bottom section 74, such that when assembled and/or configure on a container, retainer top section 72 extends out of the top 12 of retainer 10 via opening 22 in top section 20, and bottom section 74 extends into opening part of the container, which opening part is retained within cavity 13 of retainer 10. In an exemplary implementation, bottom section 74 includes one or more ridges 79 for engaging (for example by a friction fit) interior surface of an opening of a container (for example to facilitate retention of pour spout 70 in the opening of the container and/or to facilitate a liquid-proof seal).

In yet further exemplary implementation, pour spout 70 comprises a tube (e.g., an aerator tube) 76, configures to function similarly to tube 46 of spout 40.

In still further exemplary implementation, pour spout 70 further comprises a wide portion 78, which functions similarly to portion 48 of pour spout 40 (see FIGS. 2A and 6), to facilitate retention of spout 70 by retainer 10 with respect to a container.

Figure 8A:
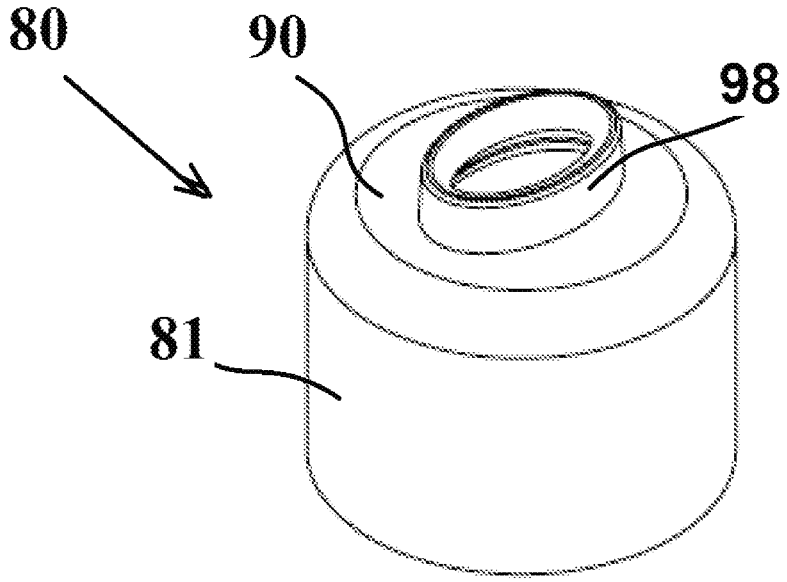
FIGS. 8A, 8B, SC, 8D, 8E, and 8F illustrate an example of a spout retainer according to further exemplary embodiments of present disclosure.
Figure 8B:
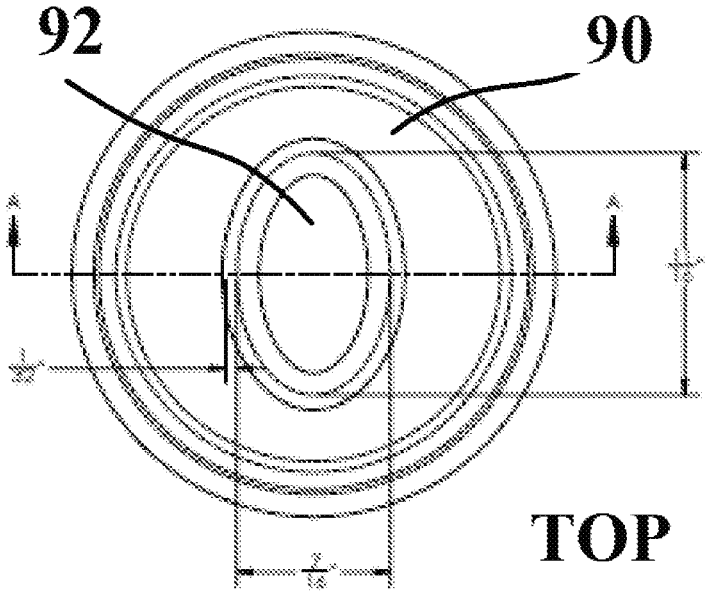
Figure 8C:
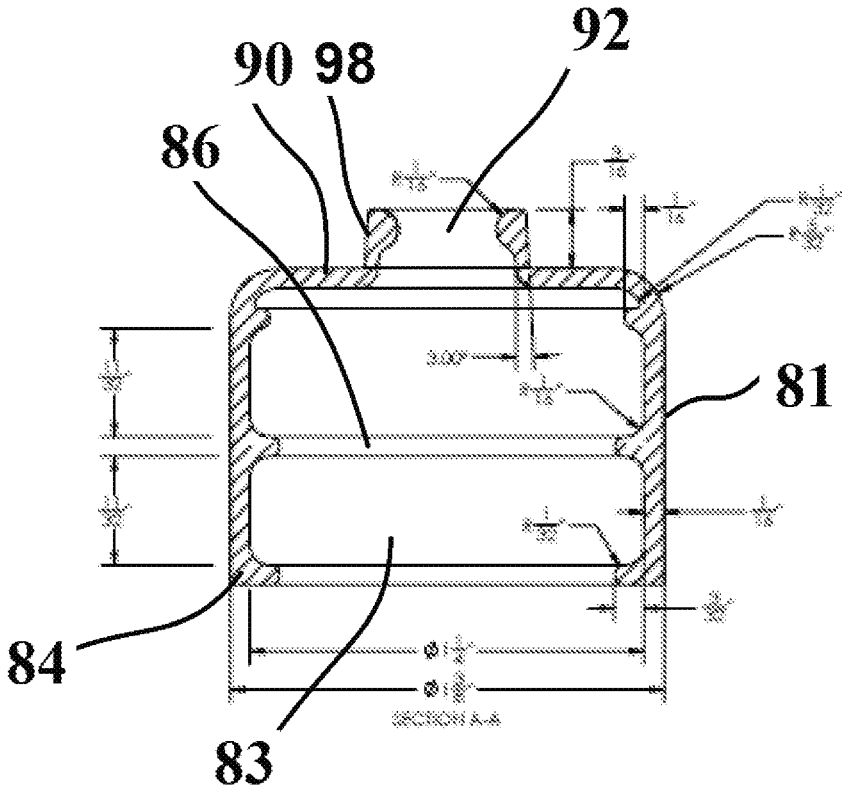
Figure 8D:
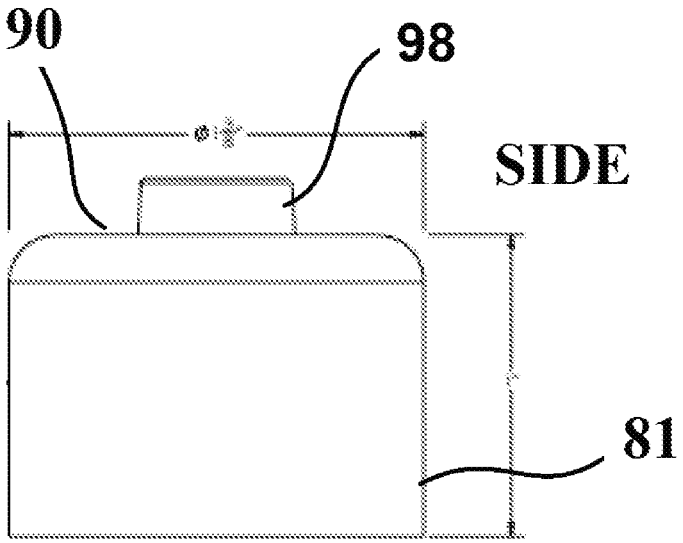
Figure 8E:
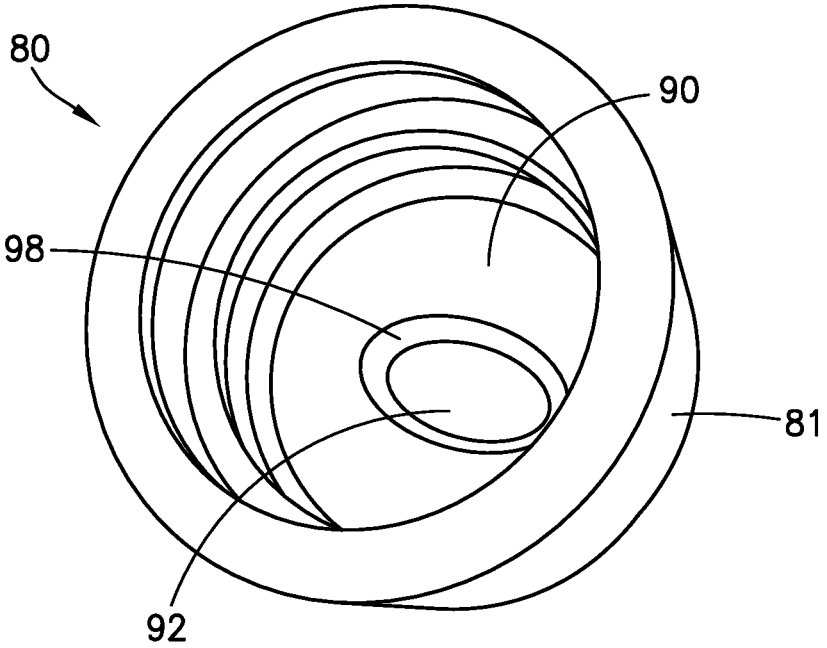
Figure 8F:
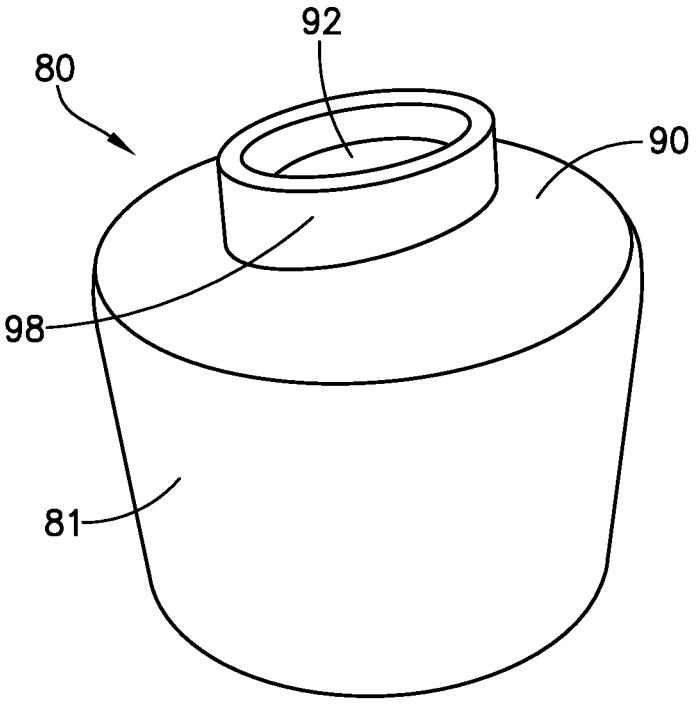

Referring to FIGS. 8A-8F, according to exemplary embodiments of the disclosure, spout retainer 80 comprises a body 81 having a hollow cavity 83 defined by an interior surface of wall 84 for receiving an open end of a liquid container such as a bottle. In an exemplary non-limiting implementation, wall 84 can be essentially cylindrical. Interior surface of wall 84 can include one or more ridges 86, for example formed as spaced circular ridges as illustrated in FIG. 8C, to interface or cooperate, for example by an interference fit, with exterior surface of an open end of a container received within cavity 83 to facilitate essentially liquid-proof fit and to retain pour spout 40, or pour spout 70, within the opening of the container. FIGS. 8E and 8F are diagrammatic representations of perspective three-dimensional views of an exemplary implementation of retainer 80, from opposite ends thereof.

According to another exemplary implementation, retainer 80 comprises a top section 90, which can be integrally formed as part of body 81 with an opening/hole 92 therethrough. In an exemplary implementation as illustrated in FIGS. 8A-8F, top section 90 can include a protrusion 98 that surrounds opening 92 for a better fit (e.g. liquid-proof) around upper section of a pour spout inserted therethrough. In yet another exemplary implementation, retainer 80 can be configured for example with an opening/hole 92 and/or protrusion 98, such that retainer 80 can be optionally used with any pour spout, such as those illustrated in any of FIGS. 5, 2A-2C, and 7, to achieve at least the advantages disclosed herein, and/or to form a system according to exemplary embodiments of the disclosure.

Figure 9A:
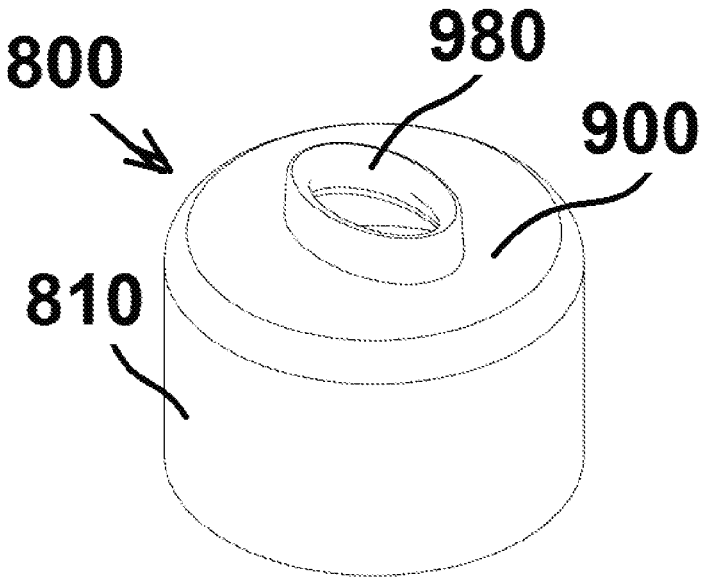
FIGS. 9A, 9B, 9C, 9D, and 9E illustrate an example of a spout retainer according to yet further exemplary embodiments of present disclosure.
Figure 9B:
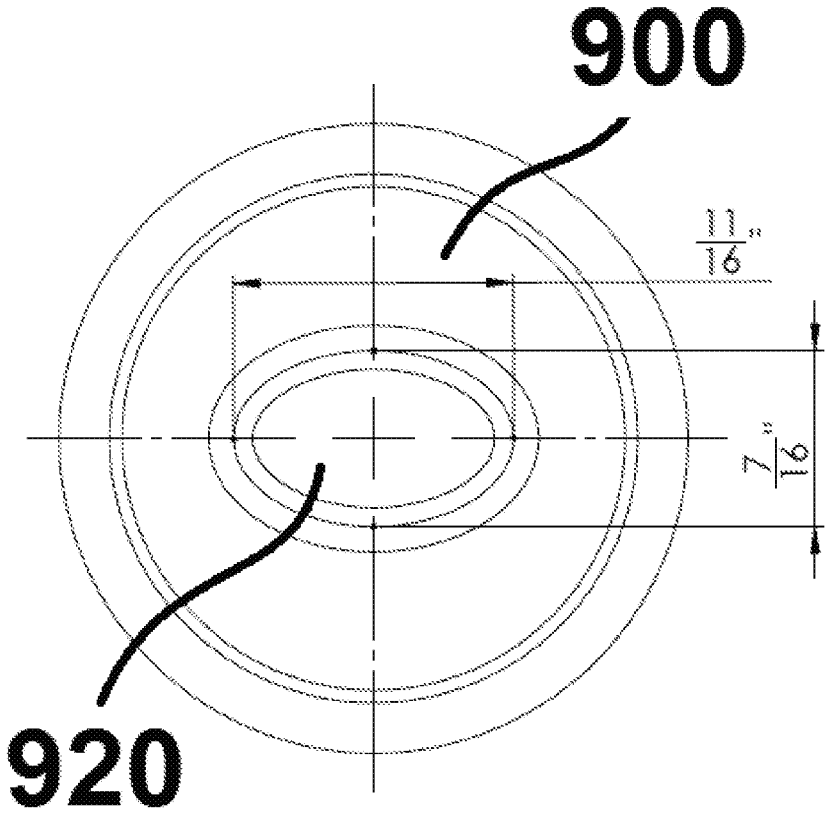
Figure 9C:
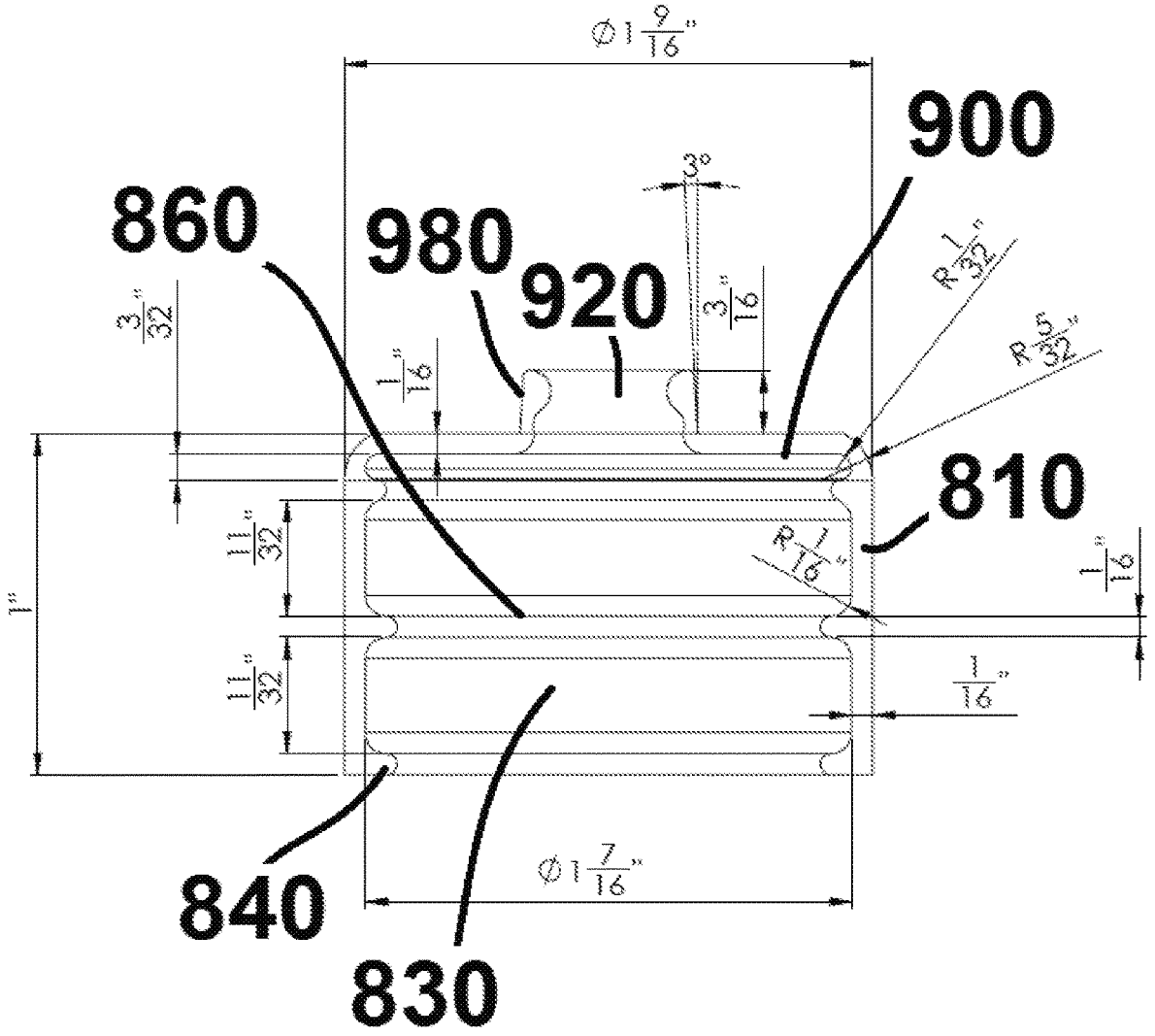
Figure 9D:
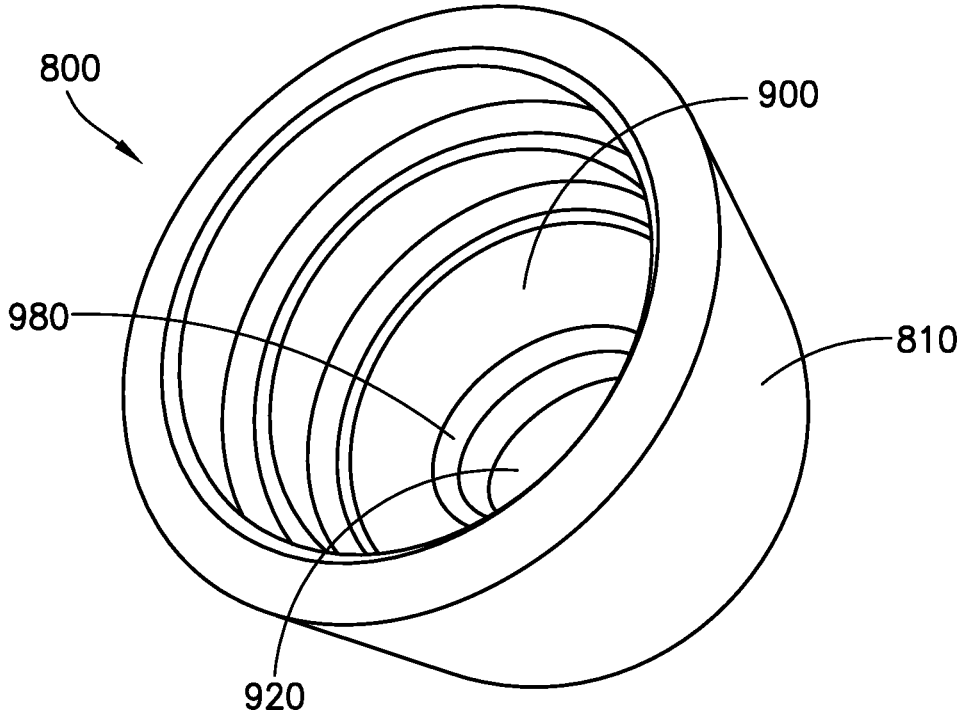
Figure 9E:
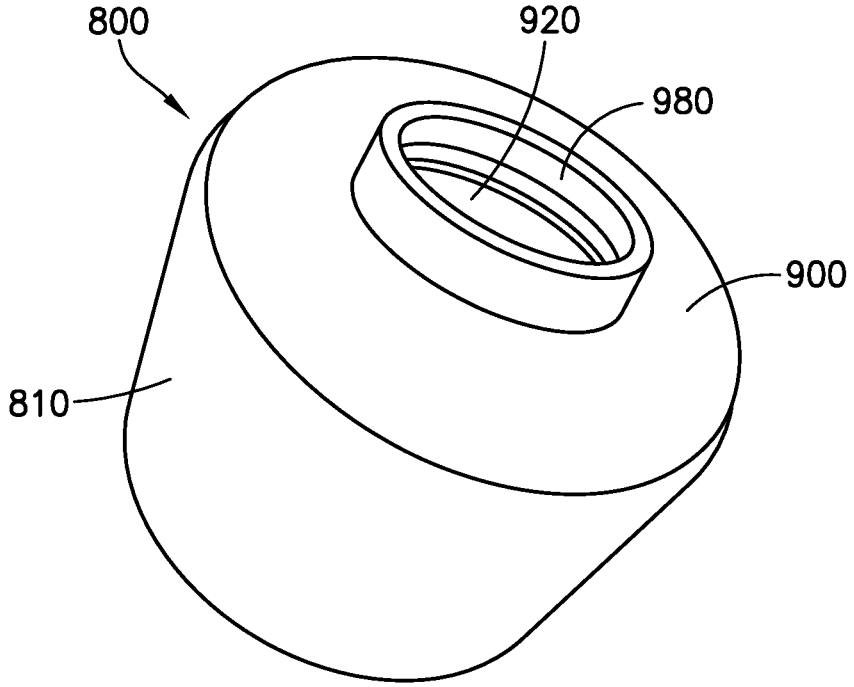

Referring to FIGS. 9A-9E, according to exemplary embodiments of the disclosure, spout retainer 800 (which can of a different, for example larger, size compared to retainer 800) comprises a body 810 having a hollow cavity 830 defined by an interior surface of wall 840 for receiving an open end of a liquid container such as a bottle. In an exemplary non-limiting implementation, wall 840 can be essentially cylindrical. Interior surface of wall 840 can include one or more ridges 860, for example formed as spaced circular ridges as illustrated in FIG. 9C, to interface or cooperate, for example by an interference fit, with exterior surface of an open end of a container received within cavity 830 to facilitate essentially liquid-proof fit and to retain pour spout 40, or pour spout 70, within the opening of the container. FIGS. 9D and 9E are diagrammatic representations of perspective three-dimensional views of an exemplary implementation of retainer 800, from opposite ends thereof.

According to another exemplary implementation, retainer 800 comprises a top section 900, which can be integrally formed as part of body 810 with an opening/hole 920 therethrough. In an exemplary implementation as illustrated in FIGS. 9A-9E, top section 900 can include a protrusion 980 that surrounds opening 920 for a better fit (e.g. liquid-proof) around upper section of a pour spout inserted therethrough. In yet another exemplary implementation, retainer 800 can be configured for example with an opening/hole 920 and/or protrusion 980, such that retainer 800 can be optionally used with any pour spout, such as those illustrated in any of FIGS. 5, 2A-2C, and 7, to achieve at least the advantages disclosed herein, and/or to form a system according to exemplary embodiments of the disclosure.

Figure 10A:
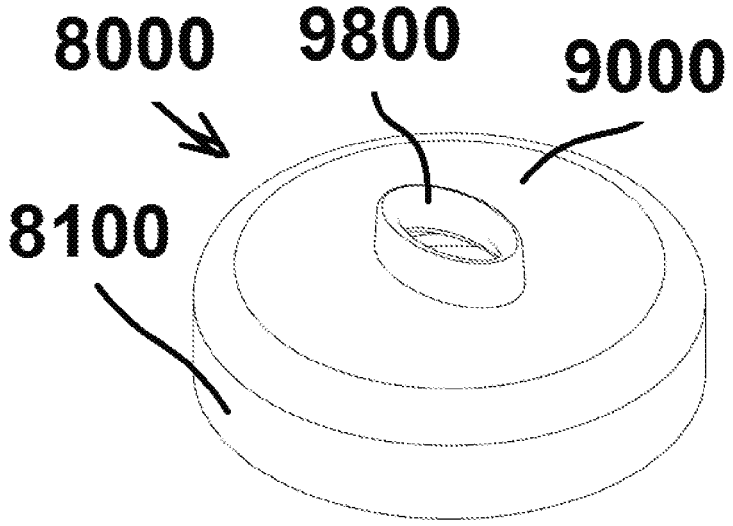
FIGS. 10A, 10B, 10C, 10D, and 10E illustrate an example of a spout retainer according to still further exemplary embodiments of present disclosure.
Figure 10B:
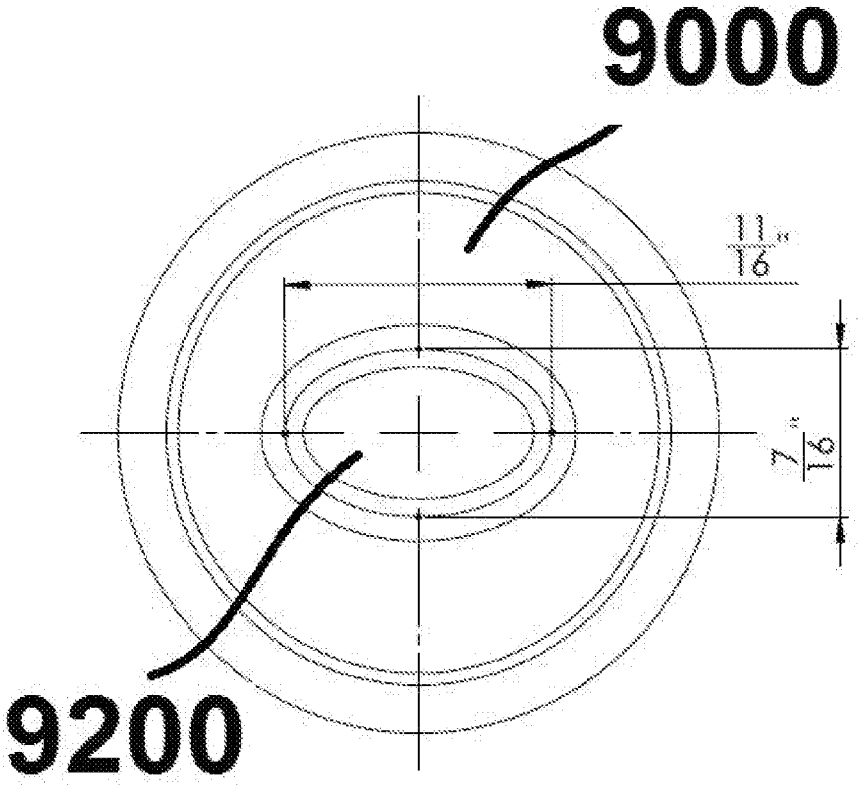
Figure 10C:
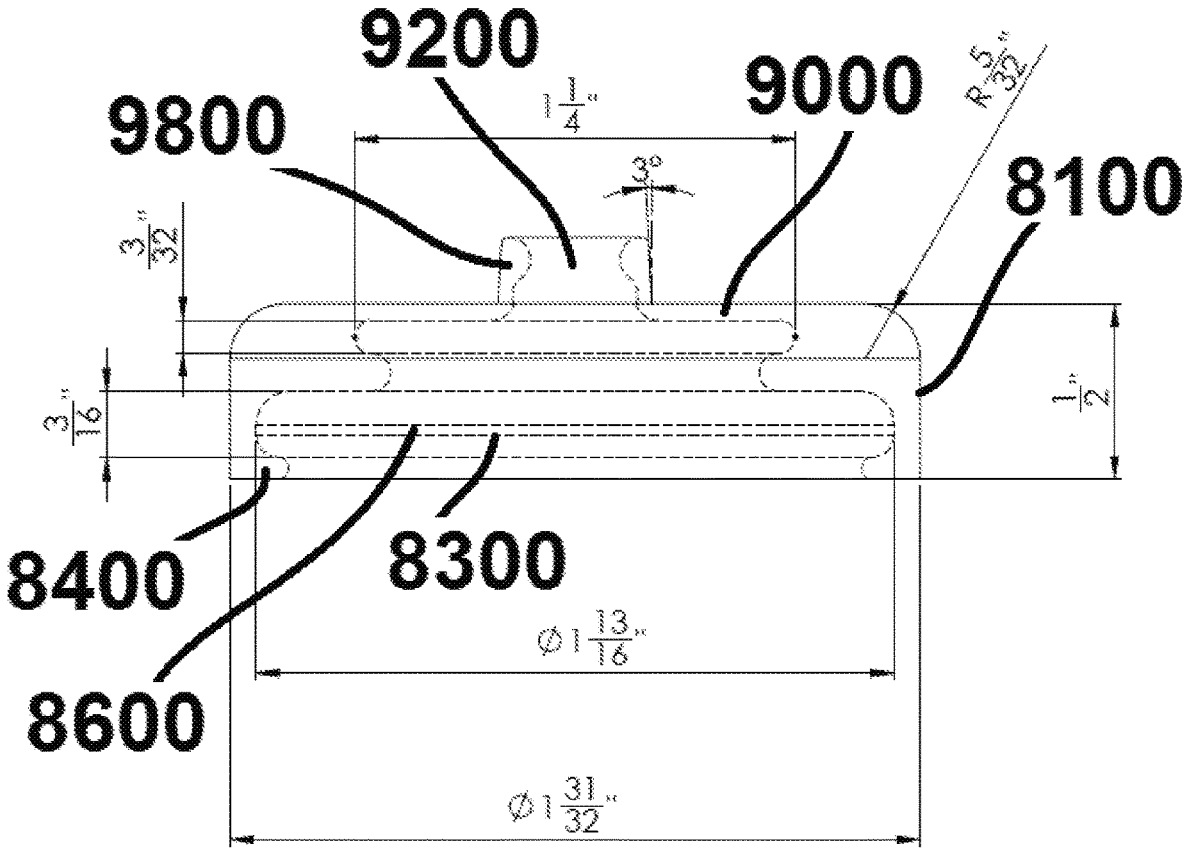
Figure 10D:
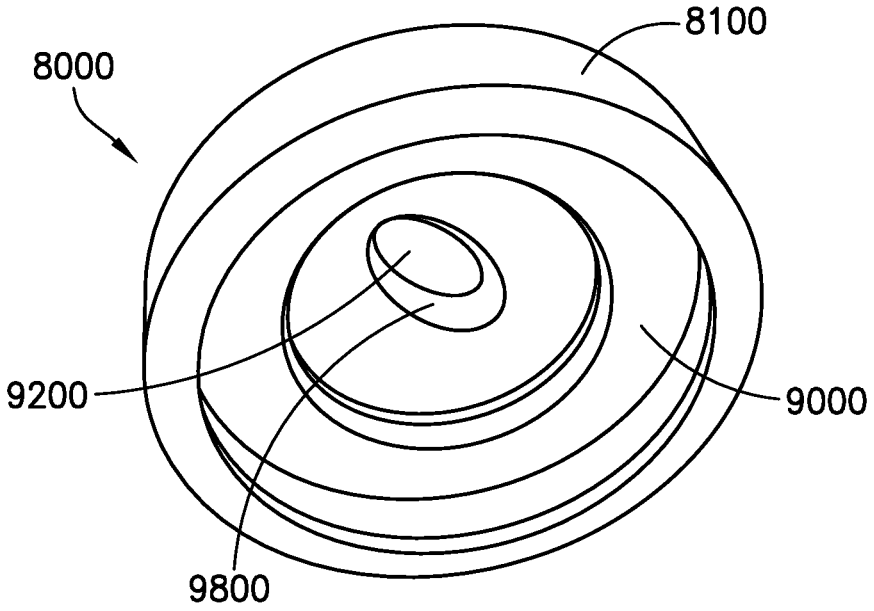
Figure 10E:
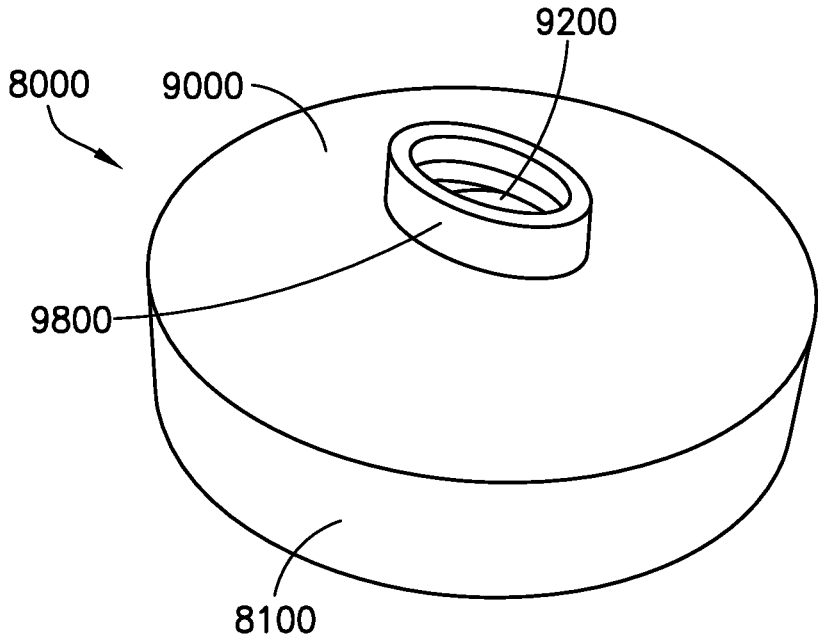

Referring to FIGS. 10A-10F, according to exemplary embodiments of the disclosure, spout retainer 8000, comprises a body 8100 having a hollow cavity 8300 (which can of a different, for example more shallow, size compared to retainer 80 and/or 800) defined by an interior surface of wall 8400 for receiving an open end of a liquid container such as a bottle. In an exemplary non-limiting implementation, wall 8400 can be essentially cylindrical in a form of a relatively small (for example, compared to wall 84 and/or wall 840) protrusion from top section 9000. Interior surface of wall 8400 can include a ridge 8600, for example formed as spaced circular ridge as illustrated in FIG. 10C, to interface or cooperate, for example by an interference fit, with exterior surface of an open end of a container received within cavity 8300 to facilitate essentially liquid-proof fit and to retain pour spout 40, or pour spout 70, within the opening of the container. FIGS. 10D and 10E are diagrammatic representations of perspective three-dimensional views of an exemplary implementation of retainer 8000, from opposite ends thereof.

According to another exemplary implementation, retainer 8000 comprises a top section 9000, which can be integrally formed as part of body 8100 with an opening/hole 9200 therethrough. In an exemplary implementation as illustrated in FIGS. 10A-10E, top section 9000 can include a protrusion 9800 that surrounds opening 9200 for a better fit (e.g. liquid-proof) around upper section of a pour spout inserted therethrough. In yet another exemplary implementation, retainer 8000 can be configured for example with an opening/hole 9200 and/or protrusion 9800, such that retainer 8000 can be optionally used with any pour spout, such as those illustrated in any of FIGS. 5, 2A-2C, and 7, to achieve at least the advantages disclosed herein, and/or to form a system according to exemplary embodiments of the disclosure.

While the present disclosure has been shown and described with reference to certain exemplary embodiments thereof, it will be understood by those skilled in the art that various changes in form and details may be made therein without departing from the spirit and scope of the embodiments of the present disclosure. Furthermore, any of the features or elements of any exemplary implementations of the embodiments of the present disclosure as describes above and illustrated in the drawing figures can be implemented individually or in any combination(s) as would be readily appreciated by skilled artisans without departing from the spirit and scope of the embodiments of the present disclosure.

In addition, the included drawing figures further describe non-limiting examples of implementations of certain exemplary embodiments of the present disclosure and aid in the description of technology associated therewith. Any specific or relative dimensions or measurements provided in the drawings other as noted above are exemplary and not intended to limit the scope or content of the inventive design or methodology as understood by artisans skilled in the relevant field of disclosure.

Thus, the description and figures are intended by way of example only and are not intended to limit the illustrative embodiments in any way except as set forth in the appended claims and their full scope of equivalents. Other objects, advantages and salient features of the disclosure will become apparent to those skilled in the art from the details provided, which, taken in conjunction with the annexed drawing figures, disclose exemplary embodiments of the disclosure. Also, various technical aspects of the various elements of the various exemplary embodiments that have been described above can be combined in numerous other ways, all of which are considered to be within the scope of the disclosure.

We claim:

1. A pouring system comprising:

a pour spout comprising a hollow interior, a bottom section for insertion into a container via an open end of said container, and an upper section extending away from the container, said hollow interior extending through said bottom section and said upper section;

a spout retainer comprising a body having a hollow cavity defined by an interior surface of a flexible wall for receiving said open end of said container; and a top having an opening for passing at least said upper section of said pour spout therethrough, said top extending along said upper section of said pour spout and away from said open end of said container, said top comprising a protrusion extending from an interior surface of said top and surrounding said opening, said protrusion forming an essentially liquid-proof seal with an exterior surface of said upper section of said pour spout passing through said opening, wherein said spout retainer is releasably fixed to said open end of said container and retains said top and said pour spout with respect to said container;

said pour spout further comprises an aerator tube extending out of said opening of said top and into said container away from said bottom section of said pour spout; and when said spout retainer is fixed to said open end of said container, said interior surface of said flexible wall of said spout retainer forms an essentially liquid-proof fit with an exterior surface of said open end of said container.

2. The system of claim 1, wherein said spout retainer retains said top with respect to said pour spout forming an essentially liquid-proof seal between said spout retainer and said pour spout.

3. The system of claim 1, wherein said interior surface of said flexible wall of said spout retainer comprises at least one ridge forming an interference fit with at least a portion of said exterior surface of said open end of said container received within said cavity of said body of said spout retainer.

4. The system of claim 1, wherein at least said top section of said pour spout is curved.

5. The system of claim 1, wherein said top and said spout retainer are integrally formed.

6. A spout retainer comprising:

a body having a hollow cavity defined by an interior surface of a flexible wall for receiving an open end of a container; and a top having an opening for passing therethrough at least an upper portion of a pour spout extending from said open end of said container, said top extending along said upper section of said pour spout and away from said open end of said container, said top comprising a protrusion extending from an interior surface of said top and surrounding said opening, said protrusion forming an essentially liquid-proof seal with an exterior surface of said upper portion of said pour spout passing through said opening, wherein said pour spout comprises an aerator extending out of said opening of said top and into said container away from a bottom of said pour spout, said body is releasably fixed to said open end of said container, and when said body is fixed to said open end of said container, said interior surface of said flexible wall of said body forms an essentially liquid-proof fit with an exterior surface of said open end of said container.

7. The spout retainer of claim 6, wherein said top and said body are integrally formed.

8. The spout retainer of claim 6, wherein said interior surface of said flexible wall of said body comprises at least one ridge forming an interference fit with an exterior surface of at least a portion of said open end of said container received within said cavity of said body.

9. The system of claim 1, wherein an exterior surface of said body of said spout retainer comprised at least one gripping portion.

10. The spout retainer of claim 6, wherein an exterior surface of said body of said spout retainer comprised at least one gripping portion.

11. The system of claim 1, wherein said protrusion extending from said interior surface of said top is flexible.

12. The spout retainer of claim 6, wherein said protrusion extending from said interior surface of said top is flexible.

* * * * *